United States Patent [19]

Parisi

[11] 4,369,544

[45] Jan. 25, 1983

[54] MACHINE TO WASH SURFACES

[75] Inventor: Sebastiano Parisi, Rome, Italy

[73] Assignee: Novum in Elettrodomestica Srl, Trieste, Italy

[21] Appl. No.: 222,260

[22] Filed: Jan. 2, 1981

[30] Foreign Application Priority Data

Jan. 14, 1980 [IT] Italy ..... 83305 A/80

[51] Int. Cl.[3] ..... A47L 11/282; A47L 11/29; A47L 11/30

[52] U.S. Cl. ..... 15/320; 15/51; 15/380

[58] Field of Search ..... 15/320, 321, 380, 51

[56] References Cited

U.S. PATENT DOCUMENTS

| | | | |
|---|---|---|---|
| 990,775 | 4/1911 | Reid | 15/51 X |
| 1,296,868 | 3/1919 | Smith | 15/320 X |
| 1,804,636 | 5/1931 | Milanovich | 15/51 |
| 1,827,905 | 10/1931 | Picker | 15/51 X |
| 2,043,878 | 6/1936 | Babbs | 15/51 |

FOREIGN PATENT DOCUMENTS

| | | | |
|---|---|---|---|
| 620039 | 3/1949 | United Kingdom | 15/51 |

*Primary Examiner*—Chris K. Moore

*Attorney, Agent, or Firm*—Stevens, Davis, Miller & Mosher

[57] ABSTRACT

The invention embodies a machine to wash surfaces which comprises:

a suction element positioned at least at its front, a front humidifier element which can possibly be shut off and which cooperates with an absorbing sheet, a sprayer which can possibly be shut off, and roller brushes. The machine also may advantageously comprise a rear absorbing sheet and an intermediate dryer.

14 Claims, 5 Drawing Figures

MACHINE TO WASH SURFACES

This invention relates to a machine for washing surfaces in private households or industrial premises.

To be more specific, the invention relates to a machine to wash surfaces and, more precisely, a machine to wash and clean surfaces by arranging for steam to carry out the washing and detergent action.

In the known art various appliances and devices exist which are suitable for cleaning floors. Some devices clear the floor by making use of suction means cooperating with rotating brushes to remove the dirt. Other devices spray detergent substances having a chemical action.

The known solutions, however, do not obtain a full and deep cleaning of the floor or wall and have been conceived for specific cleaning requirements.

These specific concepts lead to the devices being suitable for particular floors, some being fit for ceramics or marble, others for floors covered with fitted carpets, others again for plastic flooring, etc.

The present invention tends to overcome the aforesaid drawbacks and shortcomings by providing a machine suitable for cleaning substantially any kind of surface.

According to the invention the machine comprises means to remove and means to absorb the dirt, steam under pressure being employed as a softening and detergent agent.

One object of the invention is to provide suction means so as to obviate prior cleaning with a vacuum cleaner.

Another object is to provide absorption means which are easy to replace and are preferentially of a throw-away type.

Yet another object is to provide means to dry the surface which has already been cleaned.

The invention also offers various advantages together with the foregoing objects.

One advantage is the ease with which the machine can be used in the employment of steam, which penetrates deeply and removes the dirt wholly, at the same time sterilizing the room.

Another advantage lies in the fact that complete cleanliness is obtained with only one pass and without the need for further operations such as brushing, aspirating the dust, washing and drying.

The objects and advantages together with other objects and advantages that will arise in the description given hereinafter are performed by a machine to wash surfaces which comprises suction means and brush means and is characterized by including in mutual combination and coordination:

- suction means positioned at least at its front, humidifier means cooperating with absorbing means, spraying means which may possibly be shut off, and brush means,
- whereby there are advantageously present: rear absorbing means and possibly intermediate drying means.

Other details and features of the invention will stand out from the description given below by way of non-limitative example and with reference to the accompanying drawings, in which.

Figure 1:
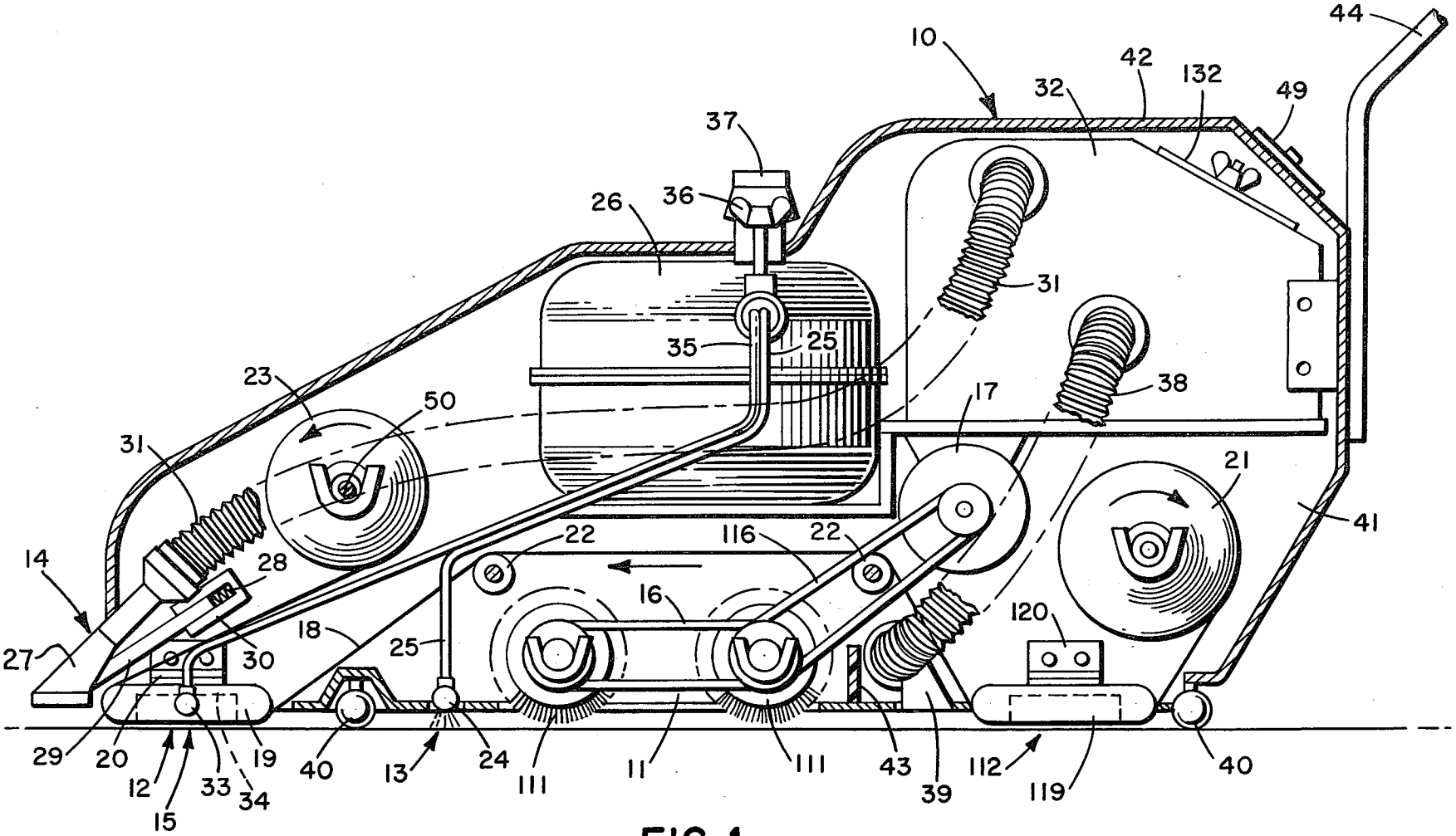
FIG. 1 shows a side elevation sectional view of the invention.

Referring to the attached figures the machine to wash surfaces is generally designated as 10 and carries brush means 11. Rollers 111 actually provide the brushing action by means of the rotary movement imparted to them by the motor means 17. A front absorbing organ 12 is equipped with a humidifier 15 and is formed essentially by a wiper 18 which unwinds from the roll 21 and is wound onto the roll 23. The machine also has a rear absorbing organ 112 which has no brush or humidifier. Sprayer means 13 spray steam and are positioned preferentially between the front absorbing organ 12 and the brush means II. The sprayer means 13 are connected to the steam generator 26 by means of pipes 25. Suction means 14 in the Figs. are retractable, being positioned at the front and connected to the dust-collecting container 32. Humidifier means 15 of the wiper 18 are connected to the steam generator 26 by means of the pipe 35. Belt 16 connects the brushes III together, while belt 116 connects the rear brush III to the motor means 17. Motor means 17 can be an electric motor or an internal-combustion motor. Wiper belt 18 is advantageously of a throw-away kind but can also be of a type which can be regenerating. Wiper belt 18 can be one (see FIG. 2) or double (see FIG. 5) and can be made of cloth, paper, fibers, a woven fabric, a non-woven fabric, etc. to suit specific requirements or needs. Wiper belt 18 has a front pressure means 19 and a rear pressure means 119. Elastic means 20 serve to press the wiper belt 18 towards the floor. Rolls 21 and 23 wind and unwind the cloth belts 18 and 118. Wiper belt 18 also has transmission means 22. Pipe 24 sprays steam and is positioned crosswise and occupies the whole width of the machine 10. Pipe 24 is provided with holes to spray the steam downwards and can be shut off as wished. Pipe 25 connects the steam generator 26 to the sprayer pipe 24. Steam generator 26 is of a known type and can be heated with electrical resistances or with other means such as, for instance, solid, liquid or fluid fuel. Intake nozzle 27 of the suction means 14 spreads substantially over the whole width of the machine 10. Springs 28 keep the intake nozzle 27 near to the floor if the intake 27 is movable. Arms 29 support the suction intake nozzle 27. Arms 29 slide within guides 30. Pipe 31 connects the intake nozzle 27 to the container 32 collecting the dust. Container 32 collects dust and is of a known type with a filter and aspirator. Container 32 has a door 132. Perforated pipe 33 positioned crosswise over the whole width of the machine 10, dampens the wiper 18 by means of steam coming from the generator 26 through the pipe 25. Pipe 33 can perhaps be shut off. Pressure means 19 has a seating 34, and in it is placed the perforated pipe 33. Pipe 35 connects the generator 26 to the perforated pipe 33. Selector switch 36 enables steam flow either to the sprayer means 13 or to the front humidifier means 15. Plug 37 works as a blow-off valve for the steam. Delivery pipe 38 feeds the drier means 39. Drier means 39 are positioned between the brushing organ II and the rear absorbing organ 112. Wheels 40 can be retracted. Machine 10 has side supporting covers 41. Uppercover 42 is hinged to the side cover 41 on the front part of the machine 10 in such a way as to enable the inside of the machine to be fully accessible. Flexible bulkhead 43 prevents interference between the action of the drier means 39 and the brush means II. Attached to machine 10 are means to push the machine by hand. Toothed pulleys 45 and 145 transmit rotation of the shaft 54 to the rolls 23 and 21. Cog belt 46 connects the pulleys 45 and 145. Rod 47, pressing against the elastic organs 20, causes the raising of the cloths 18 and 118. Supports 48 hold shaft 54. Panel 49 contains the controls. Knob 50 rotates shaft 54 or, in the first version of the invention, roll 23. Cold water tank 51 is connected to the steam generator 26 by the pipe 5. Unclamping device 53 is for withdrawal of the roll 23 or roll 21. Crankshaft 54 lifts and displaces the cloths 18 and 118. Catches 15 close the cover 42.

Figure 2:
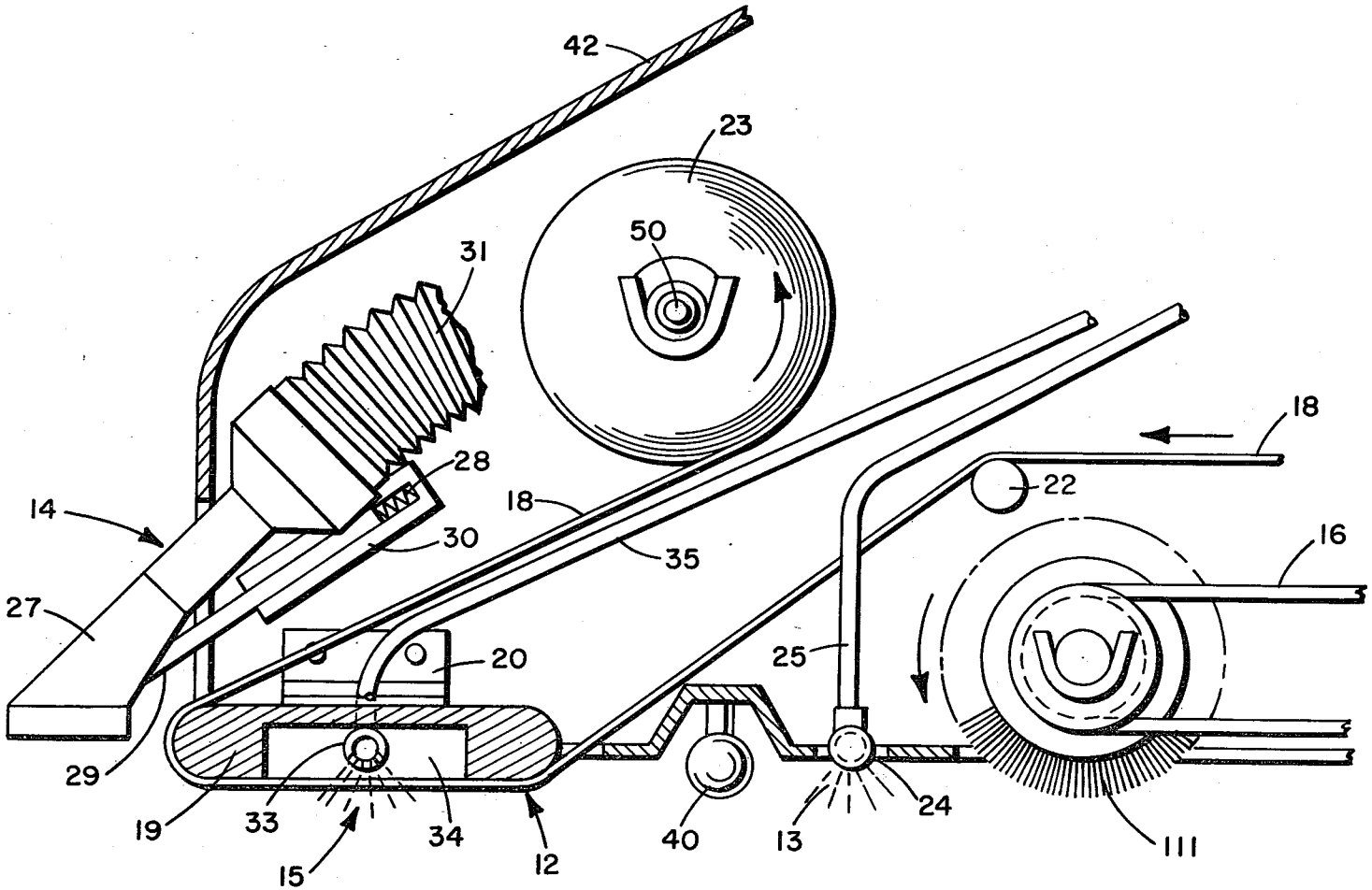
FIG. 2 shows an enlarged side elevation sectional view of the invention of FIG. 1.
Figure 3:
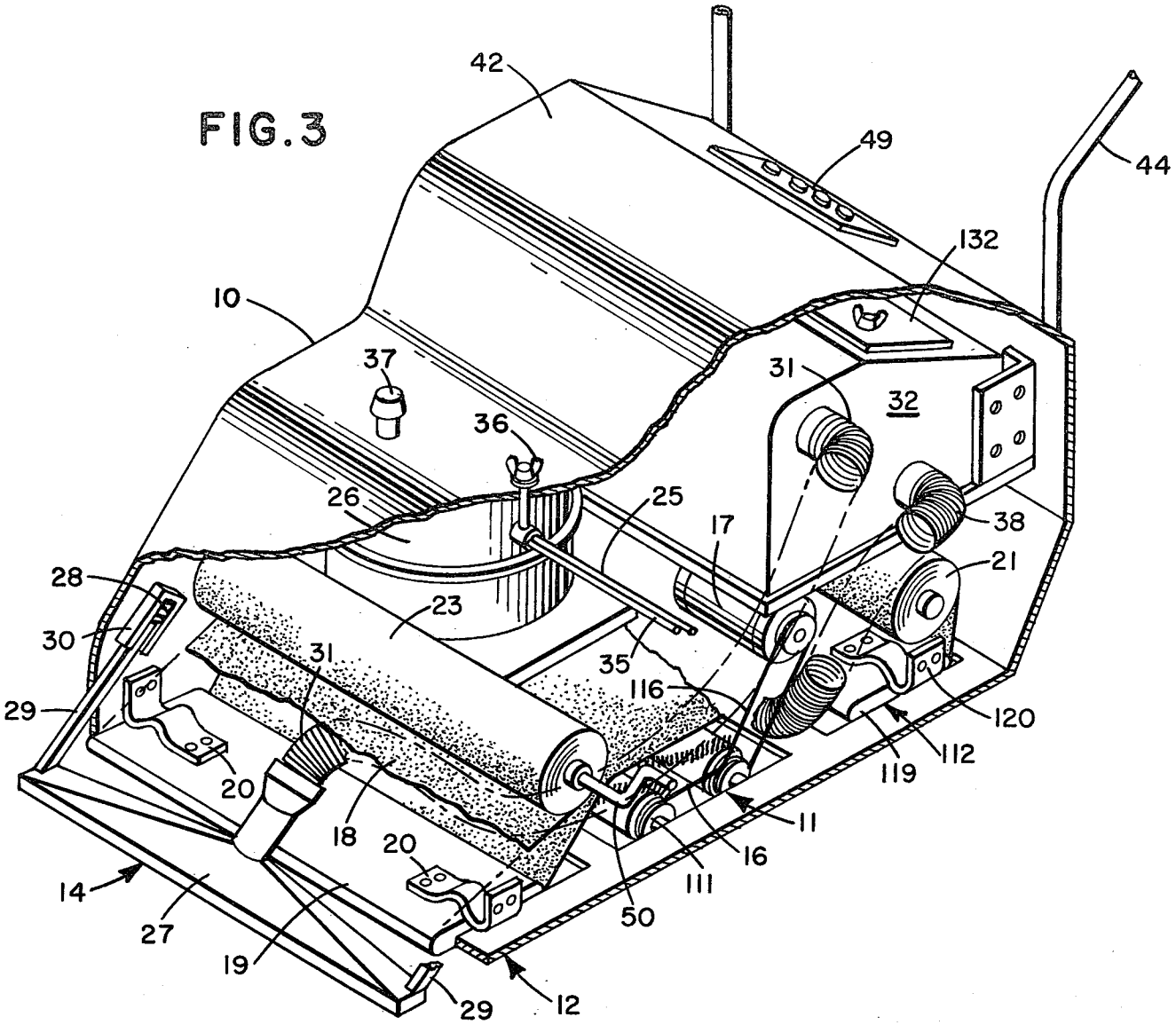
FIG. 3 shows a partially cutaway perspective view of the invention.

Looking now to the method of working of the machine 10 according to the embodiment shown in FIGS. 1, 2 and 3, the machine 10 is brought by hand to the surface to be cleaned and runs on wheels 40 kept in a protruding position.

As soon as the surface to be washed has been reached, the wheels 40 are retracted. The machine thus rests on the surface to be cleaned on its brushes II and absorbing organs 12 and 112.

The steam generator 26 is filled through the plug 37 and it is necessary to wait until the water reaches the temperature to produce steam under pressure.

If it is required to clean a ceramic or marble floor, particularly one with ceramic tiles, the selector lever 36 is set so as to feed the sprayers 13.

As the steam comes from the sprayers 13, the motor means 17 is started up and sets in rotation the brush means II. The motor of the suction group in the container 32 is also started up, thereby readying the machine for use.

The machine is pushed, by hand in the FIGS., onto the surface to be cleaned. To be more specific, the surface to be cleaned undergoes first the action of the suction means 14, which aspirate the dust through the intake 27 and deposite it in the container 32, and undergoes thereafter the action of the sprayers 13 and brush means II.

The joint action of the steam leaving the normal sprayer means 13 and of the brushing rollers III removes the dirt completely.

In particular, the steam exerts a softening action on the dirt, which is then wholly removed by the brushing rollers III. By alternating the action of the steam with that of the brushing rollers III or by imparting to the machine a forward and partially backward movement, the dirt is wholly removed. By moving forward, the machine thus cleans the surface over which it goes. The area cleaned then comes underneath the drier means 39, from which comes hot air that partially dries the floor.

The dirt, being partially free of water, is absorbed readily by the absorbing organs 12 and 112 by means of the wiper belt 18.

The presence of the pressure means 19 and 119 enables the wiper to absorb wholly by compression and wiping action the dirt removed by the steam and brush means II.

The wiper belt 18 is wound periodically onto the roll 23 by means of a knob 50 so as always to have clean wiper material 18 on the pressure means 12 and 112. The flexible bulkhead 43 prevents the air coming from the drying means 39 from disturbing the steam.

If it is desired to clean a floor covered with a fitted carpet, the selector lever 36 is set so as to feed the front humidifier means 15, while the motor means 17 is stopped. In this way the suction means 14 aspirate the dust from the carpet, while the steam coming from the humidifier 15 dissolves the dirt even when deep in the carpet and brings it to the surface, where it is absorbed by the wiper belt 18. The wiper belt 18 is wound periodically onto the roll 23 so as to have at all times a substantially clean piece of wiper belt material 18 at the pressure means 19 and 119 of the absorbing organs 12.

The drying means 39 next pass over the carpet so washed and blow hot air, thus drying the carpet partially.

The presence of the retractable suction means 14 enables the front absorbing organs 12 to be pushed even into corners which beforehand could not be reached by the existing cleaning means.

The springs 28 always tend to bring the suction means 14 back near to the surface to be cleaned.

Figure 4:
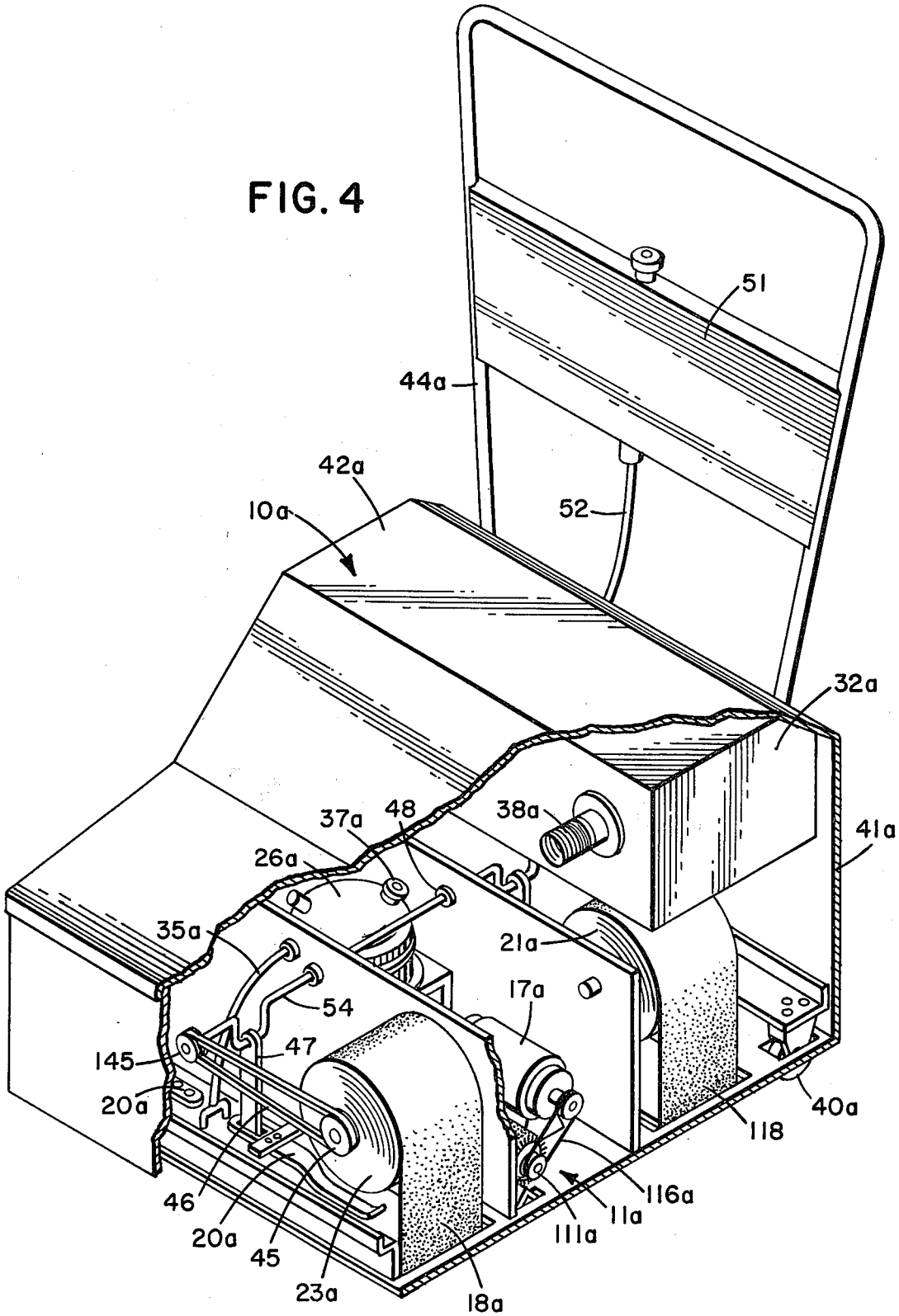
FIG. 4 shows a partial cutaway perspective view of a variant of the invention.
Figure 5:
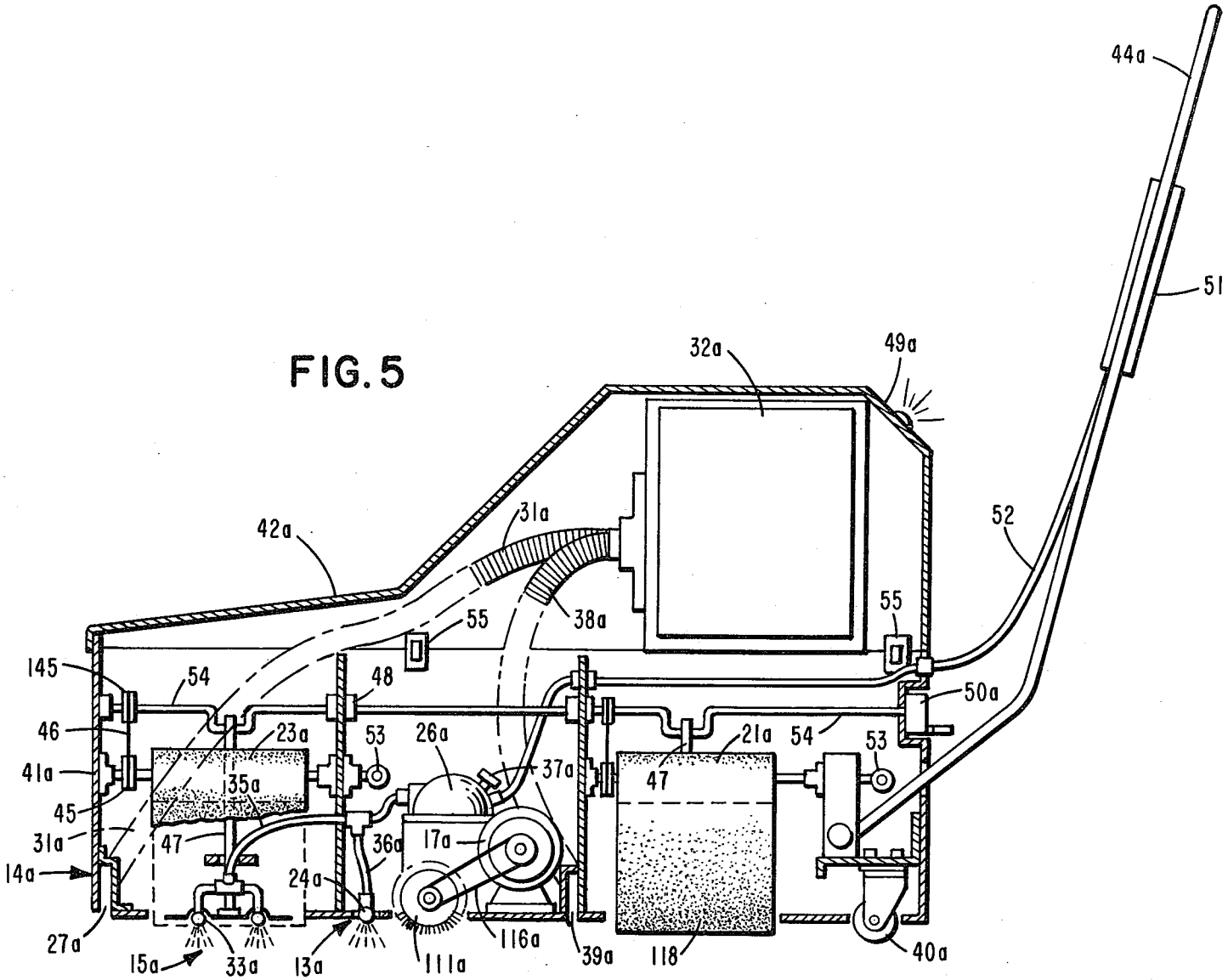
FIG. 5 shows a side elevation sectional view of the invention of FIG. 4.

Looking now to the variant of FIGS. 4 and 5, the machine is brought to the surface to be cleaned by running on its wheels 40*a*, which keep the machine a short distance from the floor. At this point the steam generator 26*a* is started up, which consists advantageously of a small tank equipped with a resistance to heat and vaporize the water.

The generator 26*a* is fed from a tank 51 through the pipe 52 and, owing to the small quantity of water treated, begins producing steam much sooner than the version described earlier.

If it is wished to clean a ceramic or marble floor, the selector 36 is set so as to make the steam flow only to the sprayers 13*a*.

When the steam begins flowing, the motor means 17*a* is started up and sets in rotation the brush roller III*a*. Furthermore, the motor of the suction groups in the container 32*a* is started up. The machine is then ready to be used. The surface to be cleaned undergoes firstly a suction action by the intake 27*a*. In this way the dust is picked up. Thereafter the action of the steam leaving the sprayer 13*a* and the action of the brush means II*a* absorb the dirt completely.

In particular, the steam exerts a softening action on the dirt, which is then wholly removed by the brush means II*a* and sucked away by the intake 27*a* if a forward and partly backward movement is imparted to the machine. By going forward, the machine thus cleans the surface over which it passes.

The cleaned area then passes beneath the drying means 39, whence comes hot air that dries the floor partially.

Being partially free from water, the dirt is readily absorbed by the cloth belts 18*a* and 118 owing to their compressive and wiping effect.

The cloth belts 18*a* and 118 are wound periodically onto the rolls 23*a* and 21*a* by the knob 50*a*, shaft 54, pulleys 45 and 145 and belt 46. The rotation of the shaft 54 causes the raising of the pressure means 19 and 119 and the simultaneous rotation of the rolls 23*a* and 21*a* with a resultant winding of the cloth belt 18*a* and 118.

If it is wished to clean a floor covered with a fitted carpet, the selector 26*a* is set so as to feed the humidifier means 15*a*. Only the motor of the suction means connected to the intake 27*a* is started up, while the motor means 17*a* stays shut off.

In this way the dust is removed, while the steam leaving through the cloth belt 18*a* dissolves the dirt in depth and brings it to the surface, where it is absorbed by the cloth belt 18*a* and 118.

In the case too the two belts 18*a* and 118 are wound periodically onto the rolls 23*a* and 21*a* so that there will always be available a tract of clean cloth.

The drying means 39 then passes over the carpet thus washed and, blowing out hot air, dries the carpet partially.

The intake 27*a* of the suction means extends over the whole width of the machine. It is therefore possible to reach without difficulty even the corners which beforehand could not be reached by the existing cleaning means.

Preferential embodiments of the invention have been described, but other variants are possible.

Thus the shapes, propostions and sized can be changed. It is also possible to visualize means able to position the brush rollers in an upright manner.

It is possible to envisage sprayer means 13 within suitably perforated rollers II carrying out the brushing action.

Thus it is possible to envisage humidifer means 15 also within the rear absorbing organ 112 with the purpose of obtaining a deeper cleansing.

It is possible to motorize the machine to wash surfaces so that it can be moved in an automatic manner.

Means can be foreseen to position the wiper and enable facilitating installation thereof.

An auxiliary suction intake 27 can be visualised as being connected to the suction pipe 31 so that the machine can be employed like a vacuum cleaner. It is possible to envisage a removable suction intake 27 and an auxiliary pipe to be inserted between the suction pipe 31 and suction intake 27.

These and other variants are possible for a technician skilled in this field without departing thereby from the scope of the invention.

I claim:

1. A machine to wash surfaces to be walked on having a front and back which comprises suction means in the front directed toward the surface to pick up loose materials from the surface, absorbing means positioned behind said suction means contactable with said surface to wipe up material loosened from the surface, humidifier means cooperating with said absorbing means to loosen material from the surface, sprayer means positioned behind said absorbing means directed toward said surface to moisten and loosen material from the surface, and brush means positioned behind said sprayer means and contactable with said surface to loosen material from the surface.

2. The machine of claim 1, wherein said brush means consist of at least one brushing roller which rotates about an axis parallel to the floor and is positioned substantially crosswise to the movement of the machine.

3. The machine of claim 1 or claim 2, wherein the absorbing means consist of at least one wiper and pressure means to elastically press the wiper against the surface to be cleaned.

4. The machine of claim 1, wherein the absorbing means comprise a wiper sheet movable along the lengthwise axis of the machine.

5. The machine of claim 1, wherein the absorbing means comprise at least one wiper sheet movable along the crosswise axis of the machine.

6. The machine of claim 1, wherein the sprayer means consist of at least one perforated pipe placed crosswise to the lengthwise axis of the machine between the brush means and absorbing means to spray liquid on to said surface.

7. The machine of claim 1, wherein the suction means consist of a suction intake extending at least crosswise to the lengthwise axis of the machine and kept near to the surface to be cleaned.

8. The machine of claim 1 wherein the humidifier means consist of a distributor pipe positioned crosswise to the lengthwise axis of the machine and in a seating present in the absorbing means.

9. The machine of claim 1 including drying means behind the brush means for blowing air.

10. The machine of claim 1, wherein said humidifier dispenses stream as a detergent substance.

11. The machine of claim 1 including means to produce steam connected to the humidifier means and sprayer means containing an adequate quantity of liquid which can be vaporized.

12. The machine of claim 11 including tank means to feed liquid to said steam producing means.

13. The machine of claim 1, wherein said absorbing means include a winding roller for winding an absorbing sheet and unclamping and clamping means for holding said winding roller in position.

14. The machine of claim 1, wherein the suction means is retractable near to a fixed edge of the machine.

* * * * *